US008973997B2

(12) United States Patent
Green et al.

(10) Patent No.: US 8,973,997 B2
(45) Date of Patent: Mar. 10, 2015

(54) SEAT STRUCTURE WITH SIT-TO-STAND FEATURE

(75) Inventors: Daniel T. Green, Monroe, MI (US); Maurice H. Dowding, Springport, MI (US); Susan E. Perry, Olivet, MI (US)

(73) Assignee: Skip's Patents, LLC, Springport, MI (US)

( * ) Notice: Subject to any disclaimer, the term of this patent is extended or adjusted under 35 U.S.C. 154(b) by 205 days.

(21) Appl. No.: 13/185,855

(22) Filed: Jul. 19, 2011

(65) Prior Publication Data

US 2013/0020779 A1 Jan. 24, 2013

(51) Int. Cl.

| | |
|---|---|
| ***A47C 1/00*** | (2006.01) |
| ***A61G 5/14*** | (2006.01) |
| ***A61G 5/10*** | (2006.01) |
| *A47K 3/12* | (2006.01) |

(52) U.S. Cl.

CPC ..... *A61G 5/14* (2013.01); *A61G 5/1067* (2013.01); *A47K 3/122* (2013.01); *A61G 2203/726* (2013.01); *Y10S 297/10* (2013.01)

USPC ..... 297/330; 297/284.11; 297/344.12; 297/344.18; 297/DIG. 10

(58) Field of Classification Search

USPC ..... 297/330, DIG. 10, 344.17, 344.2

See application file for complete search history.

(56) References Cited

U.S. PATENT DOCUMENTS

| | | | | | |
|---|---|---|---|---|---|
| 3,925,833 | A * | 12/1975 | Hunter | 4/667 |
| 4,249,774 | A * | 2/1981 | Andreasson | 297/311 |
| 4,884,841 | A * | 12/1989 | Holley | 297/331 |
| 5,513,867 | A * | 5/1996 | Bloswick et al. | 280/250.1 |
| 5,984,411 | A * | 11/1999 | Galumbeck | 297/344.15 |
| 6,068,280 | A * | 5/2000 | Torres | 280/304.1 |
| 6,142,568 | A * | 11/2000 | Abelbeck et al. | 297/344.17 |
| 6,154,896 | A * | 12/2000 | Houston et al. | 4/667 |
| 6,336,235 | B1 * | 1/2002 | Ruehl | 5/610 |
| 6,540,250 | B1 * | 4/2003 | Peterson | 280/657 |
| 6,598,246 | B1 * | 7/2003 | Shou | 4/667 |
| 6,783,179 | B2 * | 8/2004 | Komura et al. | 297/344.12 |
| 7,540,565 | B2 * | 6/2009 | Lipford | 297/325 |
| 7,735,926 | B1 * | 6/2010 | Combs | 297/339 |
| 2005/0121959 | A1 * | 6/2005 | Kruse et al. | 297/330 |
| 2006/0076813 | A1 * | 4/2006 | Mohn et al. | 297/330 |
| 2012/0274113 | A1 * | 11/2012 | Chen | 297/338 |

* cited by examiner

*Primary Examiner* — David R Dunn

*Assistant Examiner* — Alexander Harrison

(74) *Attorney, Agent, or Firm* — Young Basile Hanlon & MacFarlane P.C.

(57) ABSTRACT

A stand chair is operated by a pair of screw shaft-type linear actuators which extend upwardly and forwardly from a pair of spaced-apart frame members. One embodiment has a solid seat and another has a split seat with a drop-away front portion. One or more motors are provided to operate the screw shafts in such a way as to raise the rear seat portion without changing its angular orientation in space. Connector links interconnect the frame with the front seat portion so as to cause it to drop downwardly out from under the thighs of an occupant, while the back seat portion raises upward, thereby assisting the occupant to stand up and exit the chair. Various additional features such as armrests, wheels and a reclining backrest may also be provided.

9 Claims, 11 Drawing Sheets

SEAT STRUCTURE WITH SIT-TO-STAND FEATURE

FIELD OF THE INVENTION

This invention relates to seat structures of the type which are capable of selectively elevating so as to assist a person in getting into or out of a seat area.

BACKGROUND OF THE INVENTION

It is known to incorporate a lift mechanism into a chair to assist an occupant to sit on or get up from the chair. By way of example, U.S. Pat. No. 5,984,411 issued Nov. 16, 1999 to Michael H. Galumbeck discloses a stand chair having an articulated or "split" seat which tilts forward as it is caused to rise up by a single screw drive actuator. As the chair rises, the seat and backrest tip forward and the front portion of the split seat drops away from under the occupant's thighs.

U.S. Pat. No. 7,540,565 issued Jun. 2, 2009 to William D. Lipford shows a similar chair with a split seat which also tips forward as the seat rises. In the Lipford chair, a screw drive causes the seat to rise out of contact with a pair of vertical support members 70.

BRIEF SUMMARY OF THE INVENTION

One aspect of the present invention is to provide a lift mechanism which can safely and smoothly raise and lower a seat to provide assistance to a user. Although described herein as applied to various types of chairs, it is to be understood that the mechanism can be used in other seat structures such as those associated with toilets, treatment facilities, theaters, dining facilities, shower or bathing facilities, mobile vehicles and other devices.

In general, the lift mechanism comprises a pair of upwardly and forwardly oriented actuators mechanically connectable between a base and a seat structure to raise the seat structure relative to the base on demand. In a specific form, the base can be a frame which carries two upwardly and forwardly oriented actuators which raise or lower the seat while maintaining it in a constant orientation in space. The actuators are described herein as screw-type actuators but may be implemented in various other forms including hydraulic and/or pneumatic cylinder actuators.

According to another aspect of the invention, a "stand chair" is provided which employs either a solid or split seat and which incorporates a lift mechanism which is so arranged as to maintain the orientation of a seat constant as the seat rises up to facilitate or assist a person to get up from a seated position to a standing position.

In one embodiment, the chair has a seat which may be split into front and rear portions. The front portion is arranged so that its angular relationship to the rear seat portion changes as the rear portion rises and/or lowers. Alternatively, the seat can be solid. One or more motors are located under the seat and connected to actuators which raise and lower the seat relative to a base. The motor or motors may be mounted in any of several locations; for example, they may be attached to a seat pan so as to go up and down with the seat.

It will be understood that in the embodiments using electric motors, those motors may take AC or DC power or both. A battery-powered embodiment is disclosed along with a power supply which can recharge the battery from an AC source. This is not an exhaustive list of power sources; for example, the actuators associated with a shower or bathing facility may be powered by the pressure of water available from a nearby tap.

BRIEF DESCRIPTION OF THE DRAWINGS

The description herein makes reference to the accompanying drawings wherein like reference numerals refer to like parts throughout the several views and wherein.

DETAILED DESCRIPTION OF THE ILLUSTRATIVE EMBODIMENTS

Figure 1:
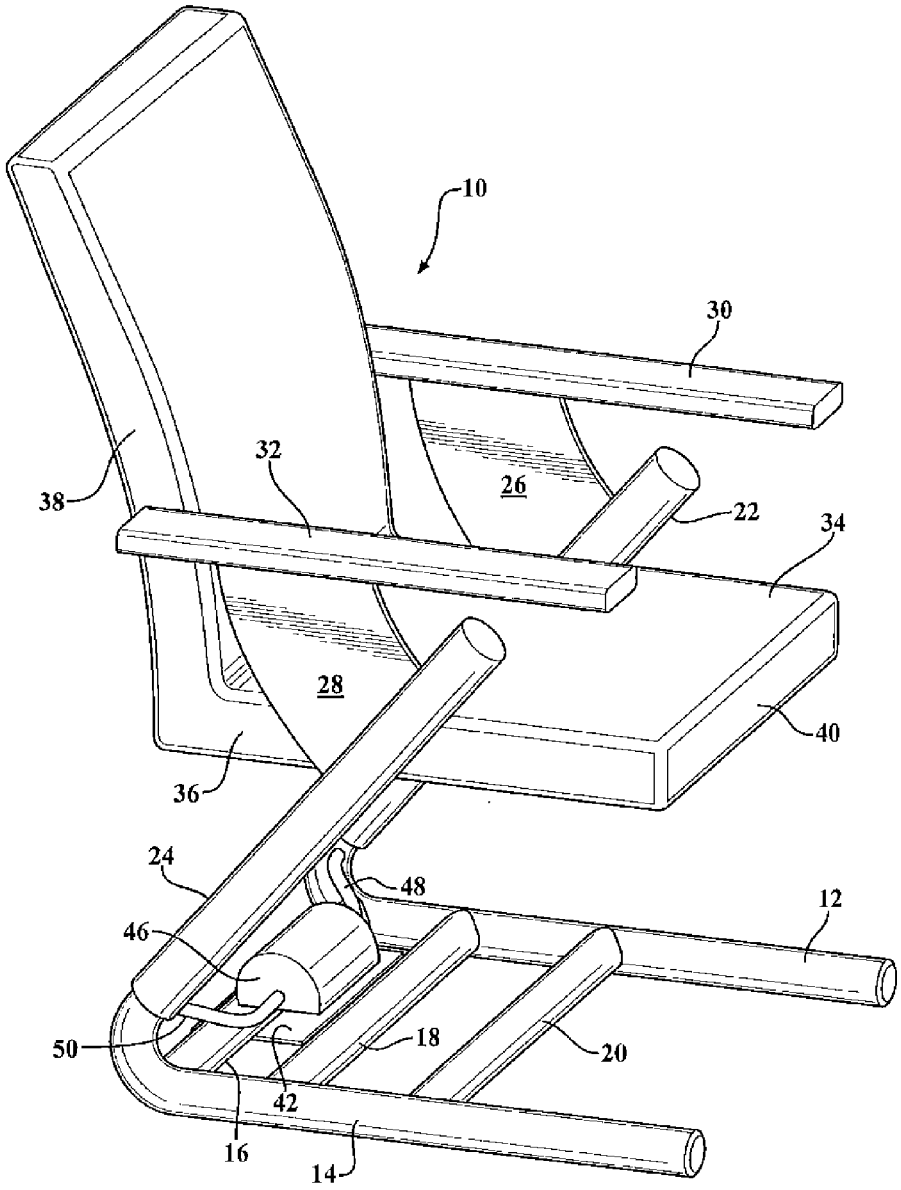
FIG. 1 is a perspective view of a first chair embodying the basic structure of the present invention with the seat and seat back in a normal sitting position.

Referring to FIG. 1 there is shown a chair 10 comprising a base in the form of a tubular metal frame having parallel spaced-apart ground engaging leg members 12, 14 joined by welded cross-members 16, 18, 20. The tubular frame members 12, 14 are integral with upwardly and forwardly extending legs to receive actuators 22, 24 having upwardly and forwardly movable cylindrical outer housings which are mechanically attached such as by welding to arcuate metal plates 26, 28 which are in turn connected as support members to parallel spaced-apart armrests 30, 32 and, via the armrests, to a seat 34.

The seat 34 is disposed between and connected by plates 26, 28 to the actuators 22, 24 so that the elevation of the seat 34 relative to the frame 12, 14 can be changed. Seat 34 is, in this embodiment, rigidly connected to a backrest 38 with armrests 30, 32. At least the seat 34 and backrest 38 are cushioned and upholstered.

A plate 42 is welded between the cross-members 16, 18 to receive a motor 46 which is connected to the actuators by cables 48, 50 so as to cause the actuators 22, 24 to raise and lower the seat 34 and armrests 30, 32 in unison. The motor 46 is excited by current which can be produced either by battery or by AC line voltage source. Alternatively or additionally, the system may have an AC to DC powered power converter which, when plugged in, keeps a battery charged.

Figure 2:
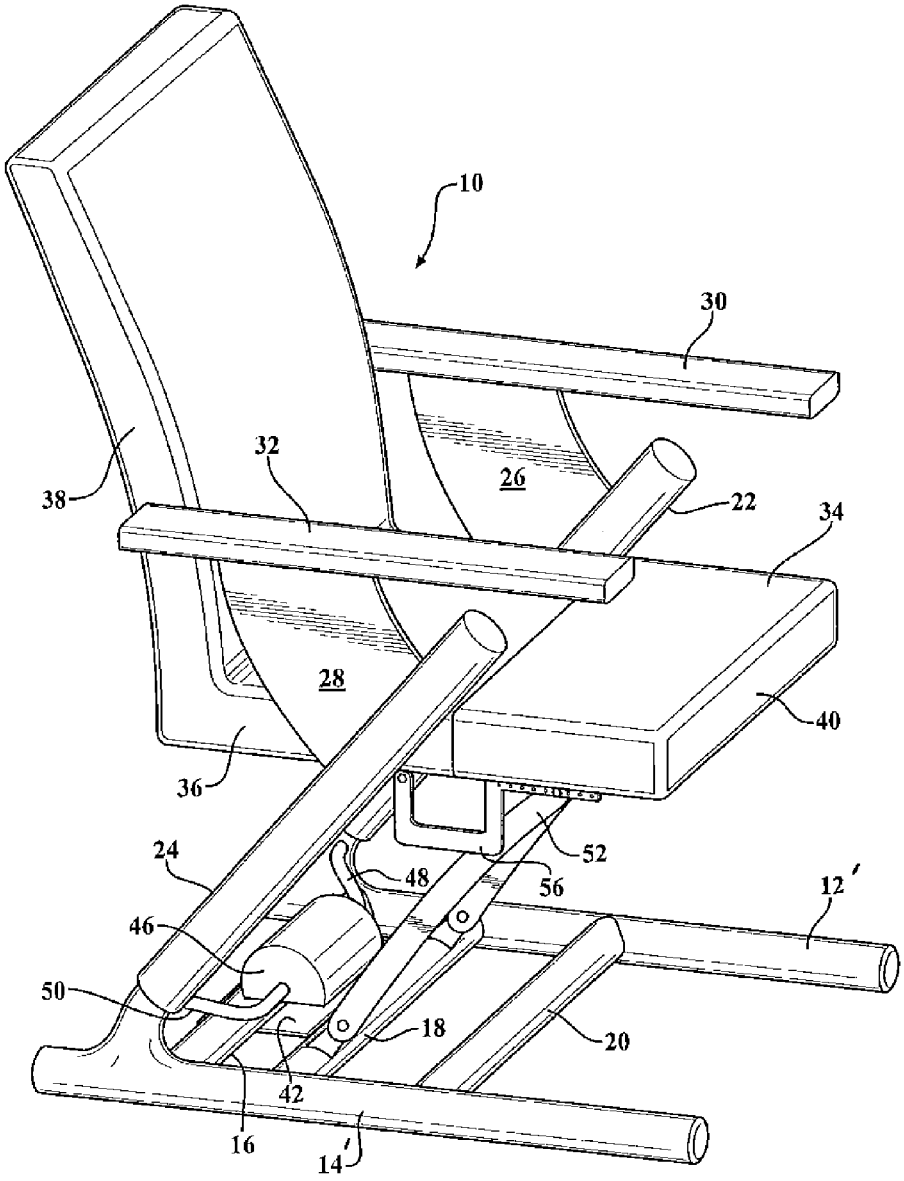
FIG. 2 is a perspective view of a chair similar to the FIG. 1 embodiment but incorporating a split seat.
Figure 3:
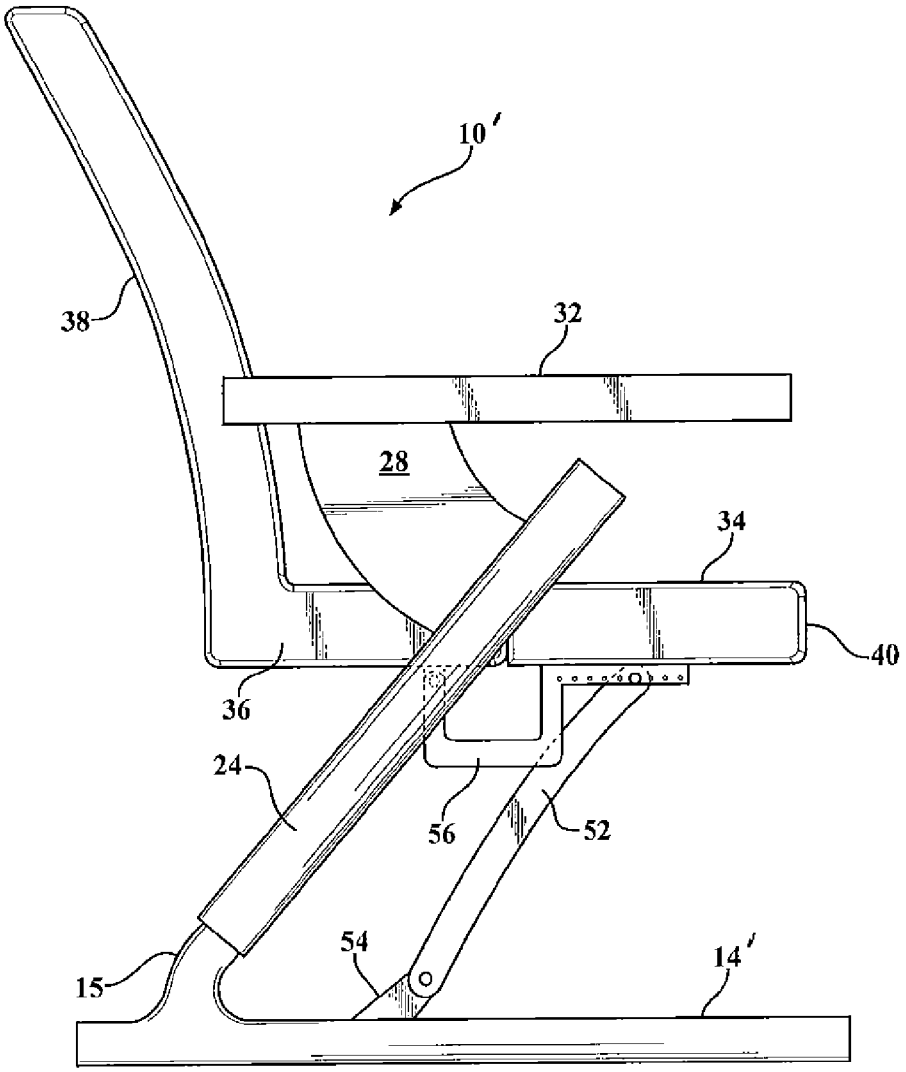
FIG. 3 is a side view of the chair of FIG. 2.
Figure 4:
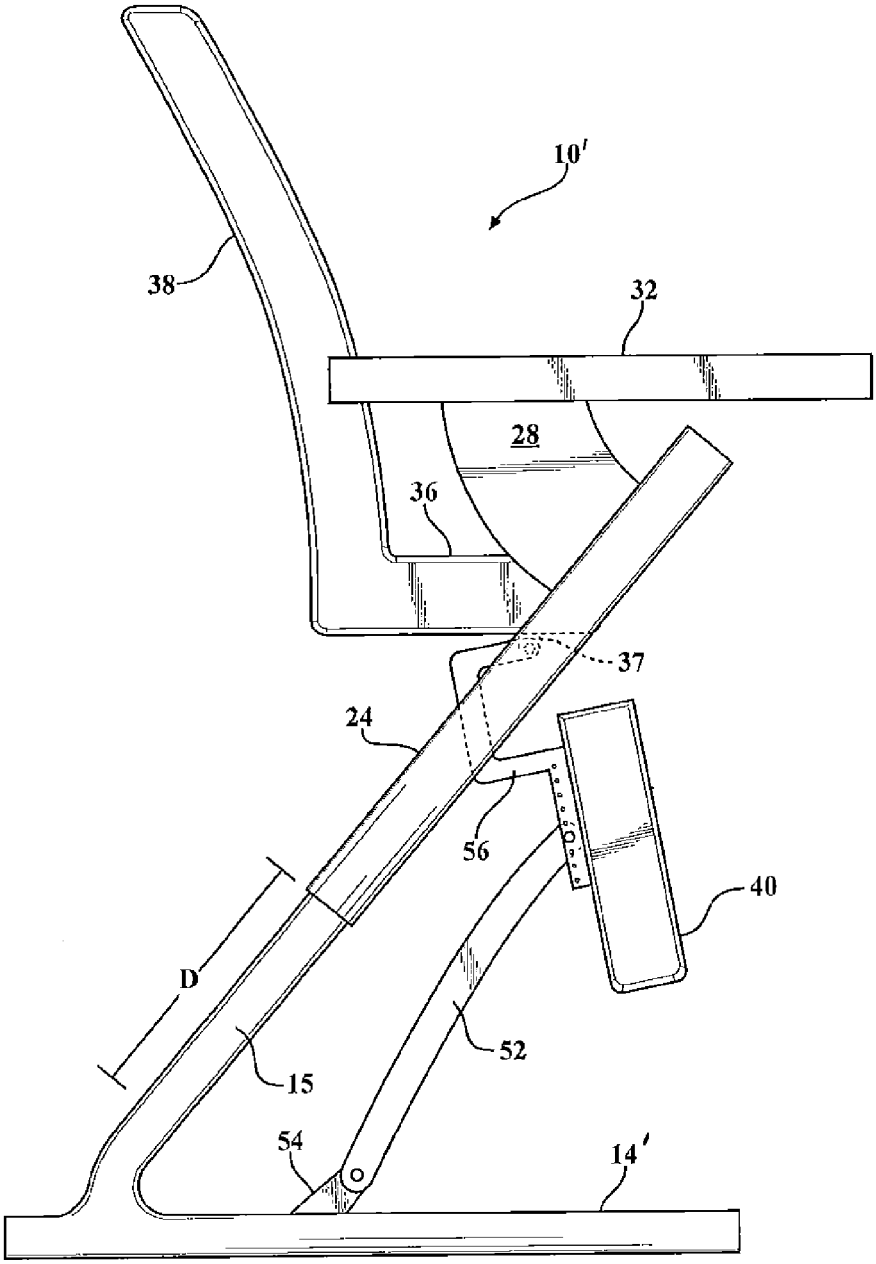
FIG. 4 is a side view of the chair of FIG. 2 with the seat and seat back in a raised position.

FIGS. 2 through 4 show a chair 10' substantially similar to the chair of FIG. 1 except for the fact that the seat 34 is divided or "split" into rear and front portions 36, 40, respectively and the legs 12' and 14' have rear extensions to prevent tipping. The rear portion 36 is rigidly connected to backrest 38 as in the FIG. 1 embodiment. Front portion 40 is hinged to the rear portion by brackets 56 so that its orientation or angle in space can change relative to the rear portion 36 as the rear portion 36 changes in elevation. Other types of hinges can be used. For example, a pair of concentric tubes, one within the other, can be used as a hinge. Control links 52 are pivotally connected between the frame member 18 by brackets 56 on one end and the lower surface of front seat portion 40 on the other end to produce the orientation change. It will be noted that the rear seat portion 36 does not change orientation as it changes elevation.

The components of the embodiment of FIGS. 2-4 which are identical to components of the FIG. 1 embodiment are given the same reference numbers. For example, the actuators are given reference numbers 22 and 24 throughout this specification. Brackets 56 are also consistently numbered.

As shown in FIGS. 2-4, the links 52 cause the forward seat portion 40 to tilt downwardly as the rear portion 36 rises, thereby producing the change in orientation shown in FIG. 4.

FIG. 3 shows the chair 10' as described above with the seat portion 36 and the back rest 38 along with the armrests 30, 32 in the lowermost or normal sitting position. In this position, the forward seat portion 40 is in the same plane as the rear seat portion 36 to provide maximum support to the occupant. Note that there are holes in brackets 56 so that the attachment points of the links 52 can be adjusted to suit the individual user.

FIG. 4 illustrates the chair 10' with the rear seat portion 36 and the seat back 38 in the raised or "stand" position caused by excitation of the motor 46 to cause the actuators 22, 24 to raise the seat upwardly and forwardly a distance D. Note that the connector links 52 assume a relatively constant position but cause the forward seat portion 40 to drop away from under the occupant's thighs, thus to facilitate departure of the occupant from the chair. Note also that the rear seat portion 36 and the seat back 38 is maintained in a substantially constant orientation; i.e., it has not tipped during the standing maneuver. Thus, an occupant enjoys a sensation of full support throughout the standing maneuver and never feels as though he or she is being thrust forwardly in such a way as to slide out of contact with the rear seat portion 36. This motion of rising to one's feet mimics the natural motion of standing from a seated position.

Figure 8:
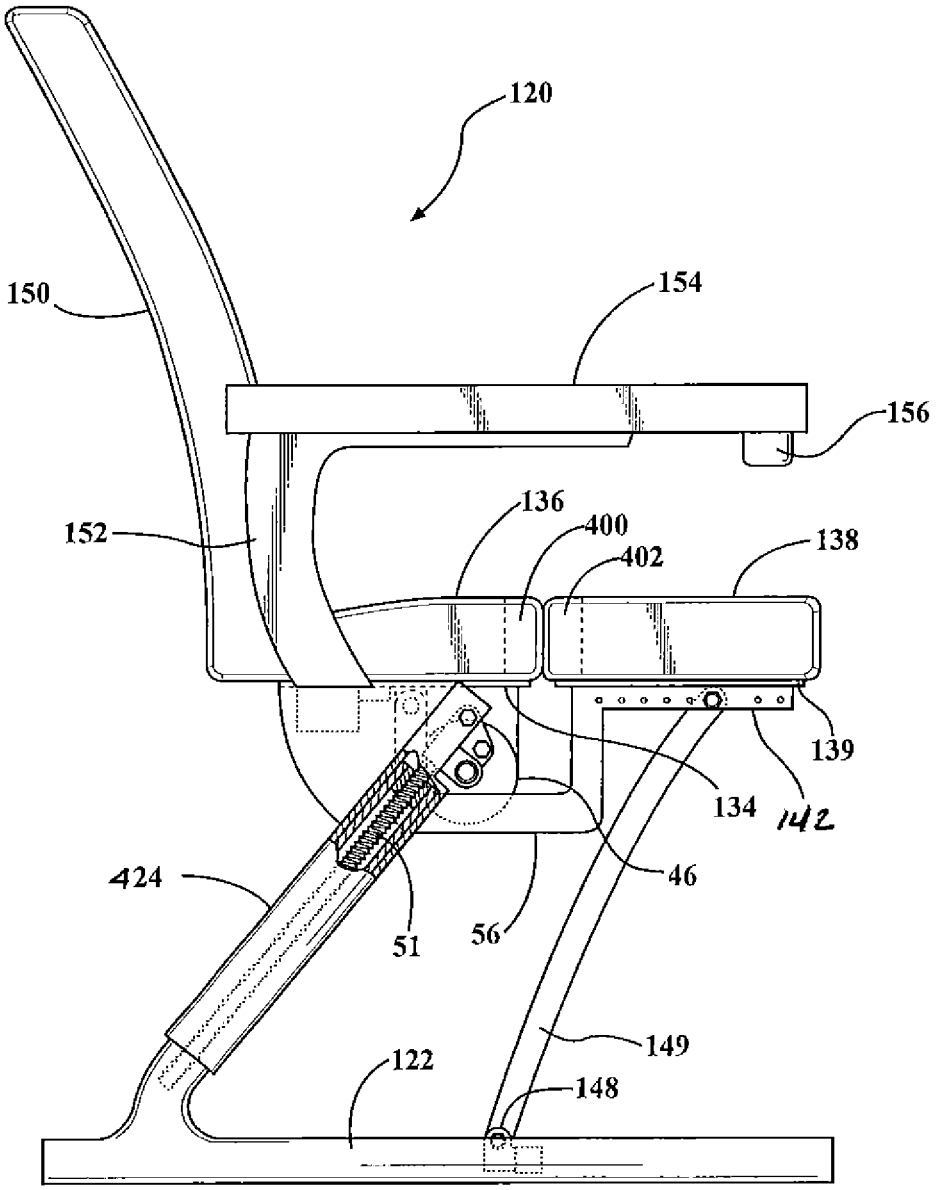
FIG. 8 is a side view of another embodiment of the invention with the seat in the supine position.
Figure 9:
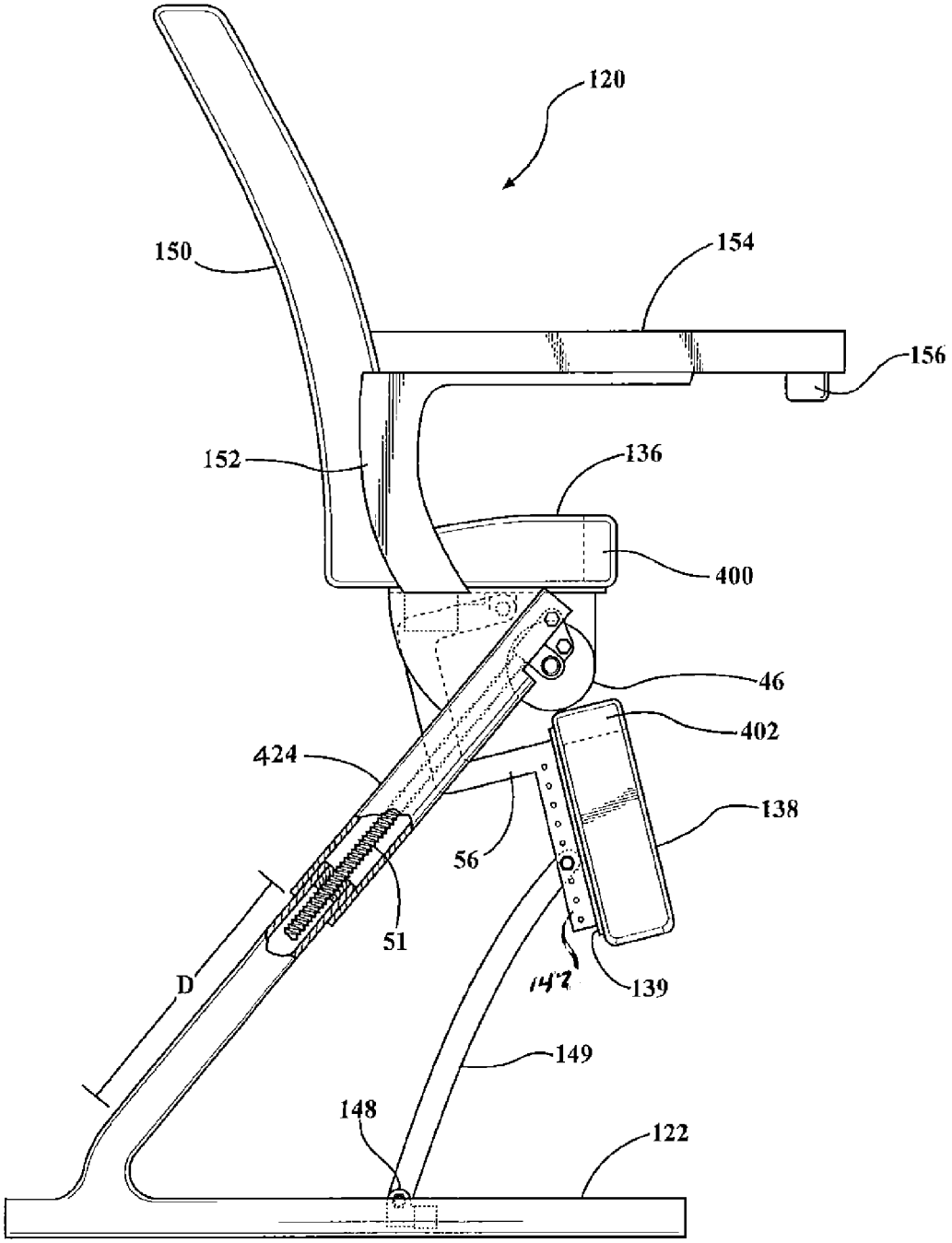
FIG. 9 is the chair of FIG. 8 with the seat in the raised/split position.

As shown in FIGS. 8 and 9, actuators 422, 424 take the form of jack screws with screw shafts 51 which extend under control of motor 46 to raise and lower the seat 36. A worm gear drive (not shown) rotates the screw shaft in a trapped nut (not shown) to extend and retract the shaft, which in turn raises and lowers the seat. Hydraulic or other actuators with conventional valve systems can also be used with substantially equivalent results. It will also be noted in FIGS. 2-4 that the links 56, while fixedly attached to the front seat portion 40, are pivotally connected at 37 to the bottom of the rear seat portion 36.

Figure 5:
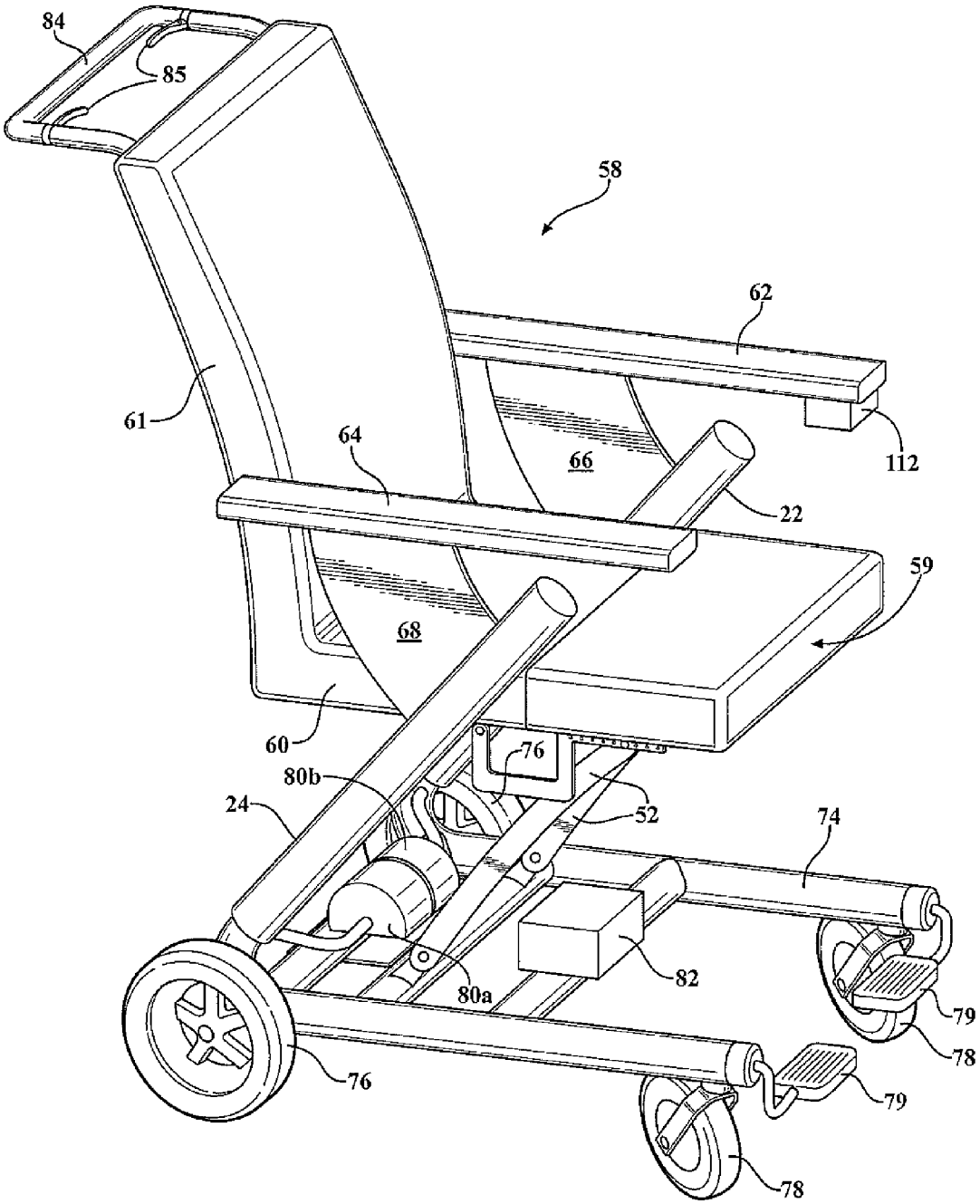
FIG. 5 is a perspective view of an embodiment of the invention configured as a transport chair and having an auxiliary battery power for operation of the actuators.

Referring to FIG. 5, a wheeled chair 58 is shown which as far as basic mechanical design is concerned, is substantially similar to the chair 10' of FIGS. 2-4. The chair 58 comprises a split seat 59 with a rear portion 60 fixedly connected to a seat back 61 having parallel spaced-apart armrests 62, 64 attached by metal supports 66, 68 to actuators 422, 424 which are identical to the actuators shown in FIGS. 1 and 2. The actuators 22, 24 are connected to a frame 74 having longitudinal tubular components as well as cross-members as described above with reference to FIGS. 1-4. The FIG. 5 embodiment has a split seat, wheels 76, 78 and fold-up foot rests 79, as well as a push bar 84 with wheel lock release levers 85.

The embodiment of FIG. 5 is provided with self-locking rear wheels 76 which allow the chair to function as a wheel chair. The wheels 76 are self-lockable so as to prevent undesired motion of the chair unless the brakes are released by levers 85. In addition, the frame is provided with swivel-type front wheels 78. A battery 82 provides DC power to a pair of motors **80*a* and 80*b* which are is connected to the actuators 22, 24 in such a way that they are always operated in up and down directions in unison. The battery 82** may also have a plug-in power supply/charger.

It will be understood that the wheels 76, 78 shown in FIG. 5 are merely illustrative and that various other types and sizes of wheels can also be used. The footrests 79 are conventional fold-up devices and no further description is deemed necessary.

Figure 6:
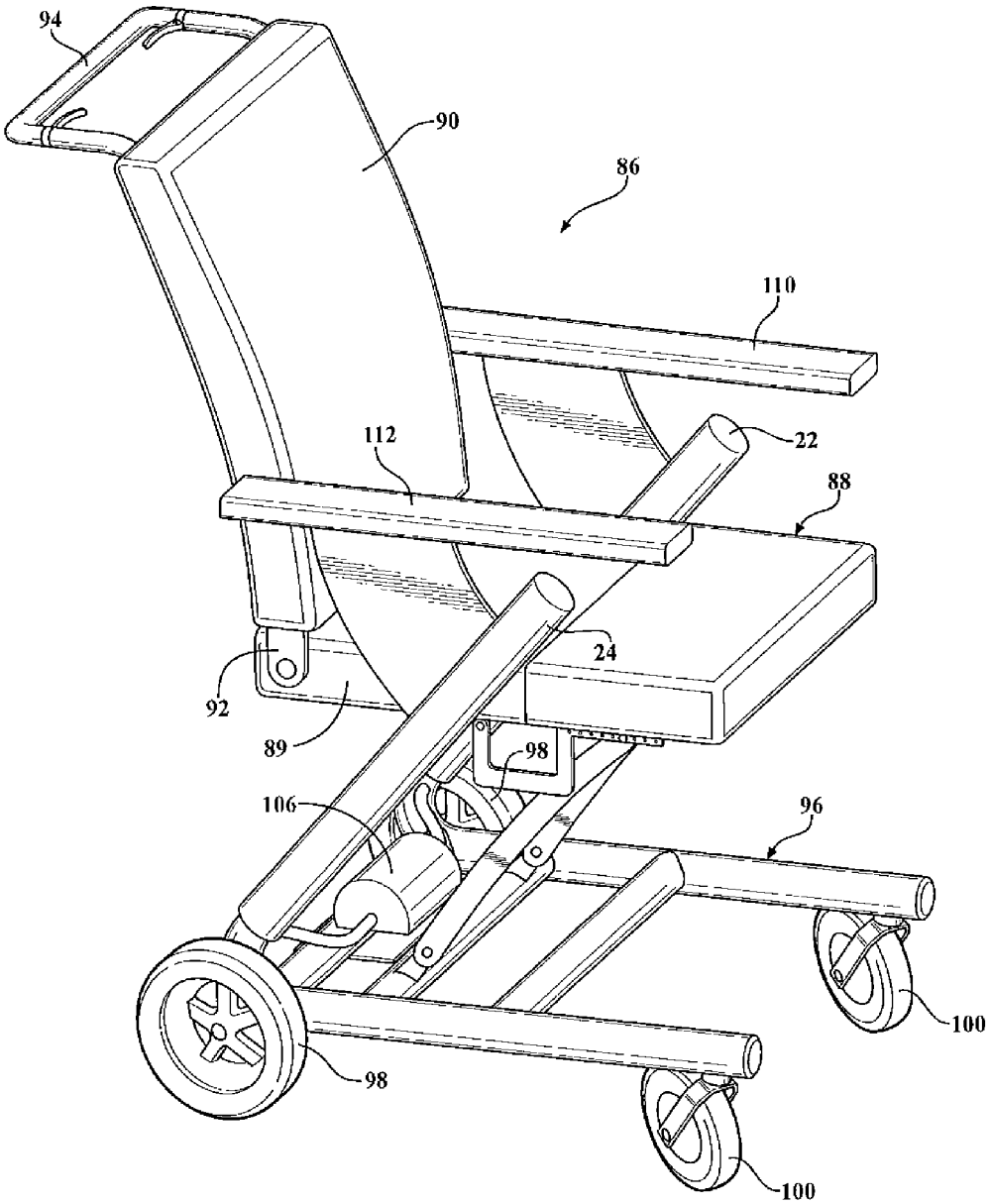
FIG. 6 is a perspective view of another transport chair embodiment of the invention with a reclining seat back capable of assuming a "Trendelenburg" position.

FIG. 6 shows another chair 86 substantially identical to the chair 58 of FIG. 5 and having a split seat 88 complete with seat back 90 as well as armrests 110, 112. Actuators 22, 24 operate in conjunction with a motor 106 to raise and lower the seat 88, 89, 90 relative to the frame 96 which, like the embodiment of FIG. 5, is equipped with wheels 98, 100.

Figure 7:
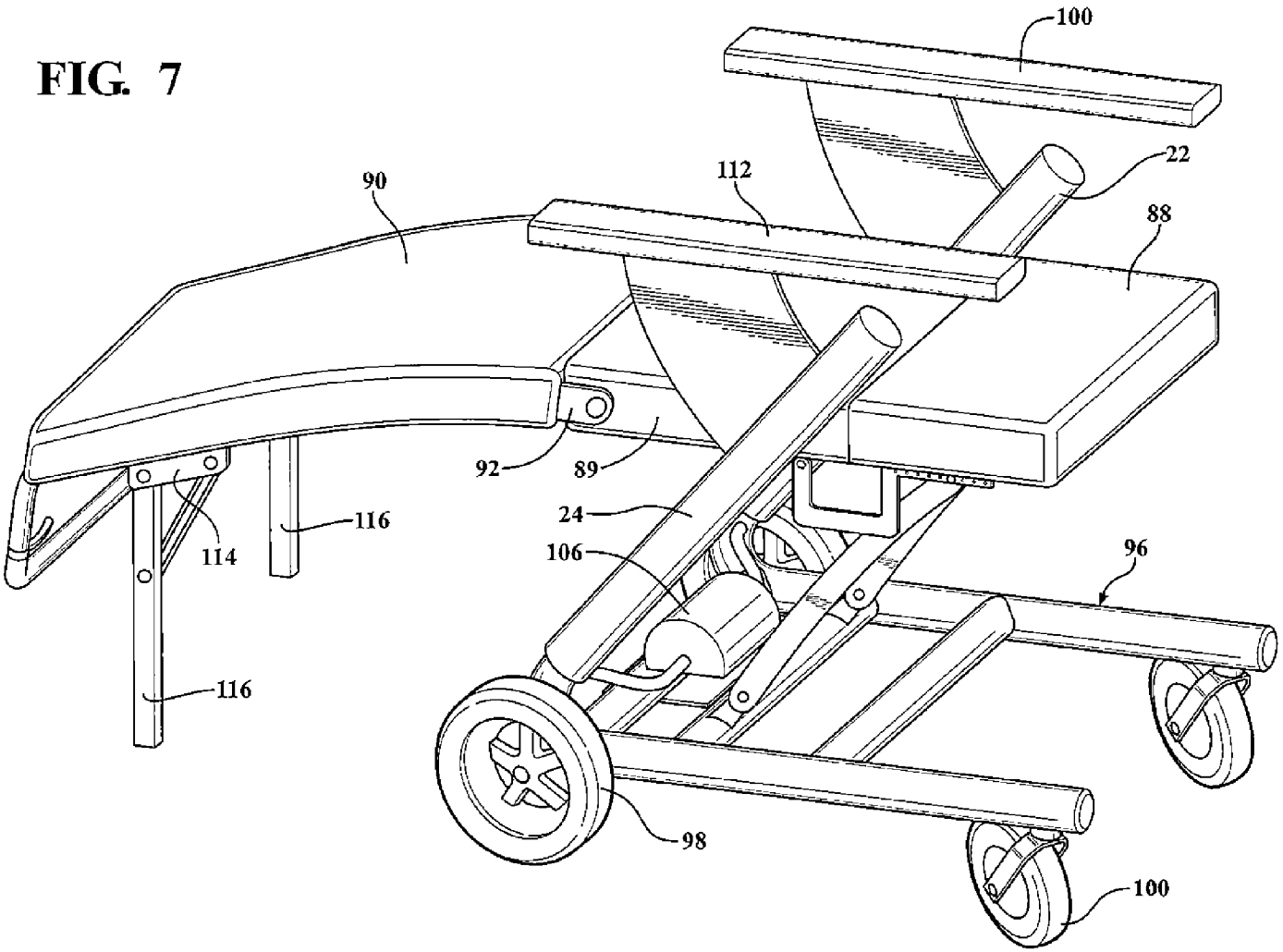
FIG. 7 is a view of the embodiment of FIG. 6 with the seat back in a supine position and further incorporating support structure for the seat back.

In the embodiment of FIGS. 6 and 7, the seat back 90 is connected by way of a releasable pivot 92 to the rear portion of the split lower seat 88 so that the seat back 90 may be lifted and then swung downwardly to a supine position shown in FIG. 7. It is often recommended that in the supine position, the seat back be oriented such that the user's head is somewhat lower than his or her head. Optional support legs 116 are connected to bracket 114 which in turn, are mounted by suitable fasteners to the seat back 90 so as to provide additional support for the seat back 90 when in the reclined position. Seat back 90 can be stopped at numerous positions between full up and the fully reclined position.

Figure 10:
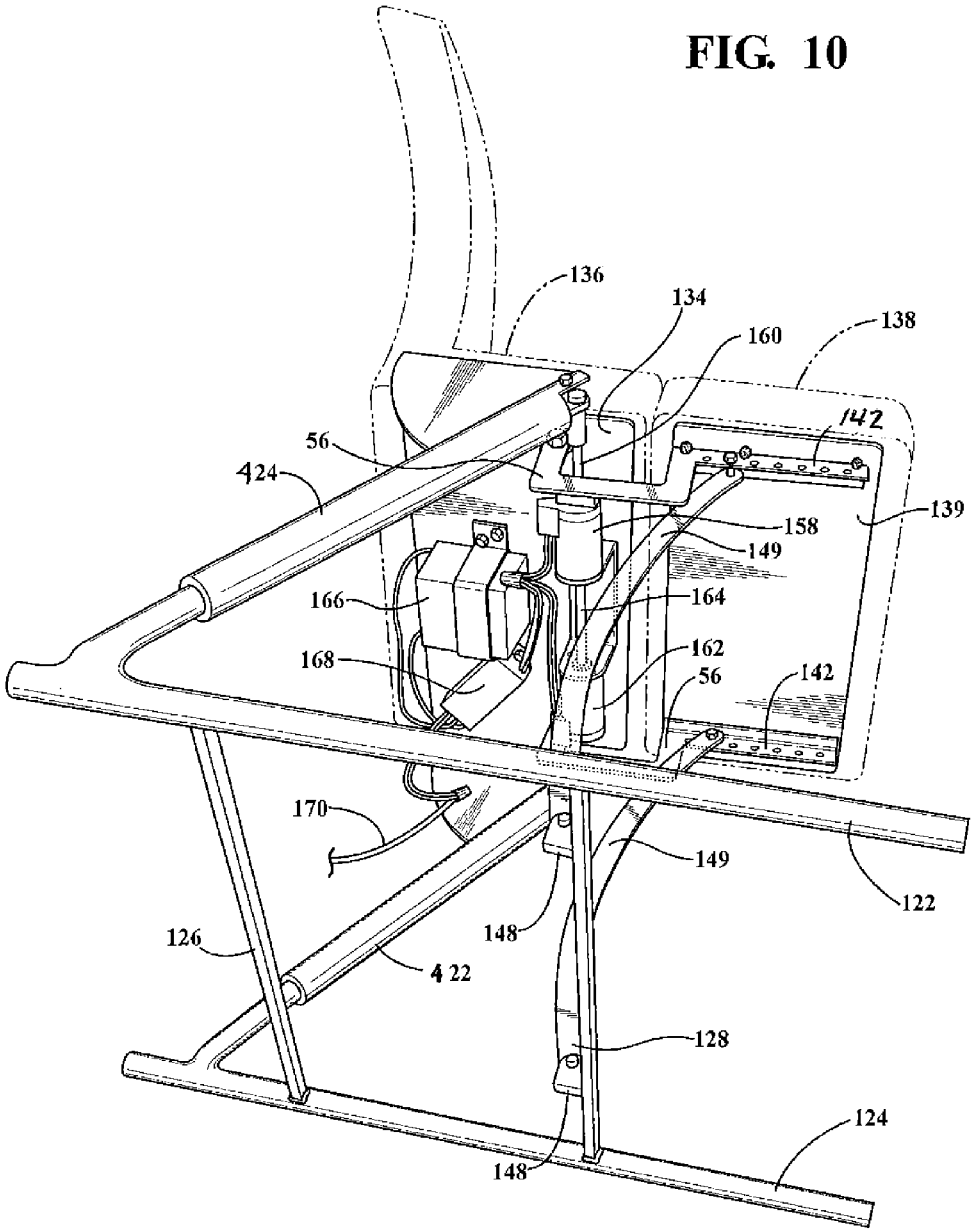
FIG. 10 is a perspective view of the bottom of the FIG. 8 chair showing one way of mounting mechanical components.

Referring to FIGS. 8, 9 and 10, a still further embodiment of the invention is illustrated. This embodiment, although generally similar to the embodiment of FIGS. 1-7, offers a number of advantages. Although illustrated as a stand chair 120 which is designed for stationary use; i.e., without wheels, and with a fixed angle seat back 150, it is to be understood that wheels, seat back pivots, push bars and other features of the embodiments of FIGS. 1 through 7 may be added to the embodiment of FIGS. 8 and 9 as desired.

Chair 120 comprises a tubular frame 122, 124 having welded cross-braces 126, 128 between the lower horizontal portions thereof. Each of the frame elements 122, 124 has an upwardly extending portion at an acute angle to the ground legs to receive screw-type linear actuators 422, 424 which are connected at the upper output ends thereof to a seat pan 134 which carries, among other things, the rear portion 136 of a split seat 136, 138. The forward or front portion 138 is mounted on a steel pan 139, the pans 134, 139 being interconnected by brackets 56 which are welded to the pan 139 but are pivotally connected to the rear seat pan 134 to permit the front and rear seat portions to go from the flat mating condition shown in FIGS. 8 and 10 to the stand condition shown in FIG. 9. The large hinge brackets 56 permit the rigid portions of the rear and front seat portions 136, 138 to be spaced widely apart in the sitting position, the gap between them being filled by soft cushioning and upholstering material 400, 402 as shown in the figures so as to eliminate any "pinch point" between the seat portion.

Brackets 56 have integral front extensions 142 mounted such as by welding to the bottom of the front seat pan 139 not only to form part of the hinge linking the pans 134, 139 but also to receive the two parallel links 149. These links 149 are connected by pivots 148 to the cross brace 128 and operate to pivot or tilt the front seat portion downwardly as the rear seat 136 rises upwardly from the normal seating position. There are holes spaced along the brackets 56 so the links can be mounted or attached at various places along their lengths. As indicated above, brackets 56 are identical to the same parts in the embodiment of FIG. 2.

Armrest brackets 152 are welded to the sides of the seat pan 134 to support armrests 154 on the right and left sides of the chair 120. A control 156 is provided on one of the arms 154 for purposes to be described.

As shown in FIG. 10, a first motor 158 is connected through a flexible output shaft 160 to the linear actuator 424 to activate same; i.e., to extend or retract the screw shaft thereby raise and lower the seat portion 136 relative to the frame 122, 124 as desired. A second motor 162 is connected through a second flexible output shaft (hidden in FIG. 10) which is connected to the screw shaft of the actuator 422 in exactly the same fashion as the motor 158 is connected to the screw shaft of actuator 424. A flexible shaft 164 is connected between the two motors, 158, 162 to maintain them in sync so that one side of the chair does not rise or lower faster than the other side. This may also be done with one motor. The motors are mounted directly to the seat pan 134 to raise and lower along with the seat. In this embodiment, the worm gear drive for the screw shaft is at the top.

A battery pack 166 is mounted to the bottom side of the back seat pan 134 along with a motor controller 168, the two being connected to a suitable 120 v AC power supply through line 170 as needed. A current sensor 168 detects the arrival of the lift mechanism at a travel limit as a function of motor current and a travel sensor located inside linear actuators 422, 424.

It will be appreciated from the foregoing description that FIG. 8 represents the chair 120 in the normal occupied condition wherein the rear and front seat portions 136, 138 are flat and immediately adjacent one another and the seating area is in the lowermost condition. When an occupant wishes to get up from the chair 120, he or she operates the motors through the control 156 to extend the screw shafts and the actuators 422, 424 thus causing the rear seat portion 136 and, in this embodiment, the seat back 150 to stand upwardly while maintaining a substantially constant angular orientation in space. As the rear seat portion 136 rises, the link 149 causes the forward seat portion 138 to swing down from the rear seat portion 136 as best shown in FIG. 8 and to change in angular orientation thereby facilitating the physical act of the occupant standing up and exiting the chair 120. The link 149 may be adjusted along the length of the bracket 56 according to the height of the occupant; holes in the brackets 56 and pins for the link 149 being provided for this relocation function.

Figure 11:
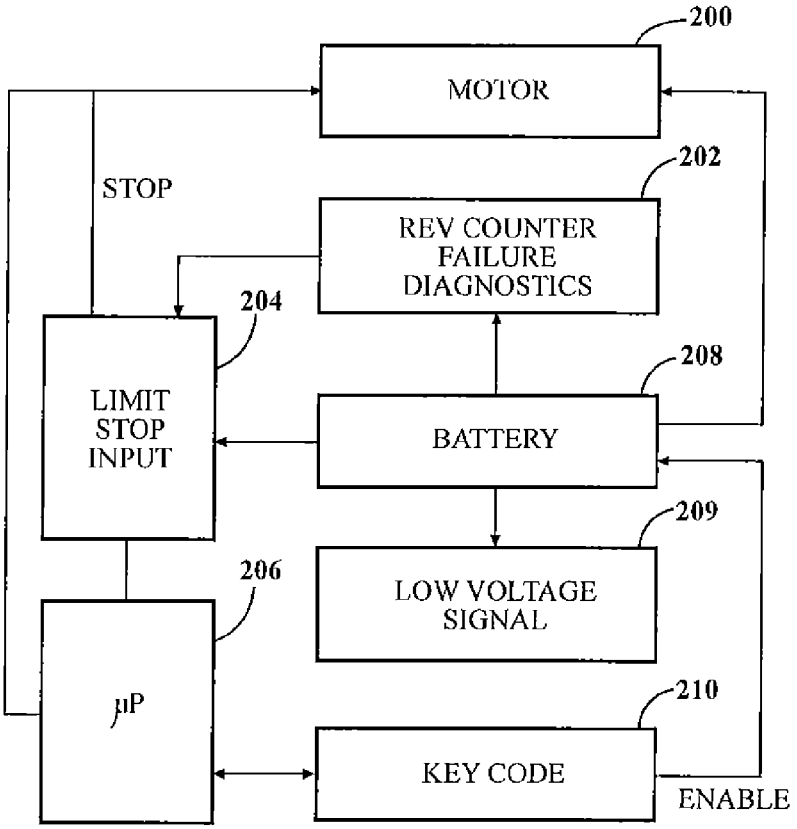
FIG. 11 is a diagram of control components in a microprocessor-based embodiment.

FIG. 11 illustrates in block diagram a controller for any or all of the chairs described above. A motor 200 operates the actuators for raising or lowering the seat as desired. Motor 200 is connected mechanically to a revolution counter 202 which may include a resolver or an optical pulse counter to keep track of how far the motor has extended or retracted the jack screw in the actuator controlled by motor 200. A programmable limit stop register 204 works in combination with microprocessor 206 to determine when to stop motor 200 at the selected limits of travel. These limits may be set by keyboard entry via processer 206 according to the size of the occupant/owner of the chair such that the register 204 sends a "stop" signal to motor 200 at the appropriate time. A battery 208 supplies power to motor 200 as well as a processor 206 via an appropriate voltage divider (not shown). Various diagnostic functions may be performed to ensure proper operation of the chair; for example, a low voltage detector 209 may be provided to issue an audible or visual alarm if battery voltage falls below a desired limit. Finally, a key card reader, key code entry or override device 210 may be provided to "enable" the entire system only by an authorized user.

Figure 12:
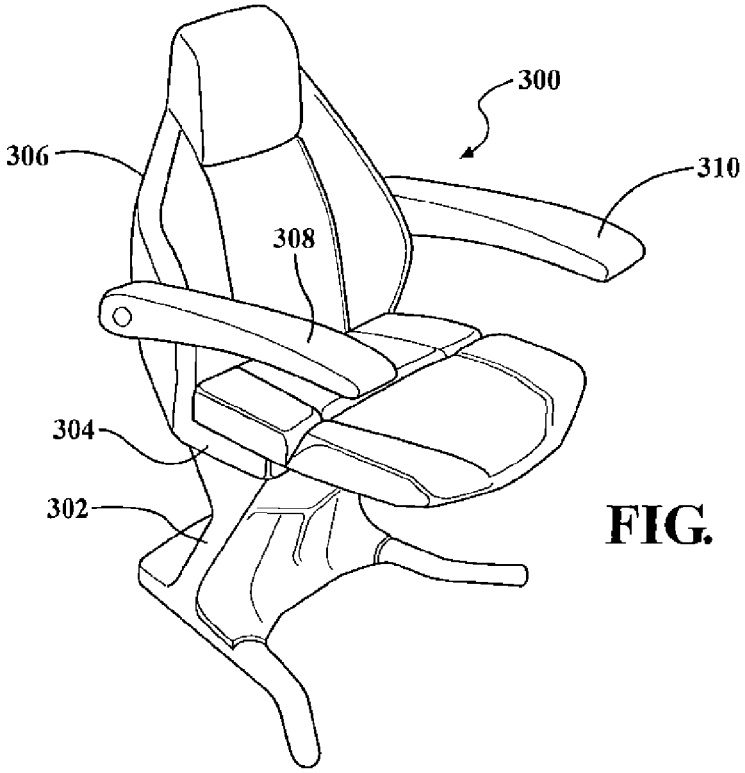
FIG. 12 is a perspective view of an example of how a chair embodying the invention might be commercially packaged for general use.

FIG. 12 is an illustration of an ornamental aesthetic design for a stationary stand chair 300 embodying the principles of the present invention. A base 302 contains actuators connected to seat portion 304 with integral backrest 306, the actuators being arranged essentially as shown in FIGS. 2-4. The seat can be split or unitary as desired. Arms 308, 310 may fold up. The seat can be upholstered in vinyl, leather, fabric or any combination of these.

It will be appreciated that the embodiments illustrated in the drawing and described above are exemplary and that implementation of the invention can be carried out in various other configurations.

What is claimed is:

1. A seat structure comprising a base;

a seat having a backrest and a seat portion adjacent the backrest and mounted to said base in a generally horizontal orientation;

said base comprising a hollow tubular frame including a pair of parallel, spaced-apart, horizontal floor-engaging members and contiguous therewith a pair of parallel, spaced-apart side members extending from the rear of said floor-engaging members upwardly and forwardly on opposite sides of said seat, and a pair of linear actuators disposed within said side members and operatively connected to fully raise and lower the seat, wherein the actuators extend upwardly and forwardly in straight lines such that raising said seat causes said seat and said backrest to move together upwardly and forwardly along a straight linear path while said seat maintains a generally constant angular orientation in space.

2. A seat structure as defined in claim 1 wherein the actuators include screw shafts; the combination further comprising a motor to operate said actuators in concert.

3. A seat structure as defined in claim 1 wherein the seat structure further comprises a pair of armrests disposed on opposite sides of and above said seat; said upwardly and forwardly inclined side members and said actuators being connected to the armrests to raise and lower the seat and armrests as a unit without significantly changing the angular orientation thereof.

4. A seat structure as defined in claim 3 further comprising a control to establish travel limits for the actuators.

5. A seat structure as defined in claim 2 further including a battery for powering the motor.

6. A stand chair as defined in claim 5 further including a low voltage alert for said battery.

7. A sit-to-stand chair comprising:

a base comprising a lower frame carrying a motor and a pair of upwardly and forwardly extending, parallel spaced apart rigid hollow, tubular side frame members;

a seat comprising a generally horizontally seat portion and a backrest portion and two spaced-apart armrests arranged such that one armrest is on each side of the seat and is connected to a respective tubular side frame member;

a pair of linear actuators enclosed within said side frame members and having straight line actuation axes and connected to said motor for operation in concert and not independently, the actuators being connected at upper ends thereof to respective armrests to raise and lower the seat and backrest together in concert and in a straight line path by actuation of said motor.

8. The seat structure of claim 7 wherein said seat includes:

a front seat portion and a rear seat portion wherein the front seat portion is pivotally connected to the rear seat portion such that the orientation in space of the front seat portion can change relative to the rear portion as the rear portion changes in elevation.

9. The seat structure of claim 8 further comprising:

at least one control link of fixed length, wherein the at least one control link is pivotally connected to the base at one end and pivotally connected to the front seat portion at the other end to cause the front seat portion to decline as the rear seat portion ascends.

* * * * *